US011441322B1

(12) United States Patent
Thielk

(10) Patent No.: US 11,441,322 B1
(45) Date of Patent: Sep. 13, 2022

(54) WALL LIFTING ASSEMBLY

(71) Applicant: John Thielk, Fair Haven, MI (US)

(72) Inventor: John Thielk, Fair Haven, MI (US)

( * ) Notice: Subject to any disclaimer, the term of this patent is extended or adjusted under 35 U.S.C. 154(b) by 0 days.

(21) Appl. No.: 17/324,830

(22) Filed: May 19, 2021

(51) Int. Cl.
*E04G 21/16* (2006.01)
*E04G 21/14* (2006.01)
*E04B 2/70* (2006.01)

(52) U.S. Cl.
CPC ..... *E04G 21/142* (2013.01); *E04G 21/168* (2013.01); *E04B 2/70* (2013.01); *E04G 21/165* (2013.01)

(58) Field of Classification Search
CPC ... E04G 21/142; E04G 21/168; E04G 21/165; E04B 2/70
See application file for complete search history.

(56) References Cited

U.S. PATENT DOCUMENTS 3,574,981 A 4/1971 Henschen
3,727,885 A 4/1973 Jones
5,634,301 A 6/1997 Koller
5,833,430 A * 11/1998 Reynolds ..... B66C 23/202 52/DIG. 1
6,000,898 A * 12/1999 Sharp ..... E04G 21/168 414/800
6,089,809 A * 7/2000 Dellinger ..... E04G 21/168 254/338
8,287,221 B1 10/2012 Van Roekel
9,085,441 B2 7/2015 Mullins
9,469,510 B2 * 10/2016 Phillip ..... E04G 21/18
D843,818 S 3/2019 House
10,570,608 B2 2/2020 Bertuca

FOREIGN PATENT DOCUMENTS

CA 2188630 4/1998
DE 19549535 C2 * 1/2001 ..... B28B 23/0025

* cited by examiner

*Primary Examiner* — Adriana Figueroa

(57) ABSTRACT

A wall lifting assembly includes a bracket which includes a lateral portion forming a right angle with a lower portion and forming a right angle with an upper portion. The lower portion is spaced from the upper portion to define a wall space for insertably receiving a top plate of a framed exterior wall. The bracket has an attachment point integrated and a lifting line can engage the attachment point. In this way the framed exterior wall can be lifted with the lifting line when the bracket is positioned on the framed exterior wall. A plurality of nuts is each of the nuts is coupled to the upper portion of the bracket. A plurality of bolts is each threadable through a respective one of the nuts when the top plate is positioned in the wall space to inhibit the top plate from sliding out of the wall space when the bracket is lifted.

7 Claims, 7 Drawing Sheets

WALL LIFTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to lifting device and more particularly pertains to a new lifting device for lifting a framed exterior wall of a building. The device includes a bracket which has a wall space integrated therein. The wall space insertably receives a top plate of the framed exterior wall. A lifting line can be attached to the bracket to facilitate the framed exterior wall to be lifted.

(2) Description of Related Art Including Information Disclosed Under 37 CFR 1.97 and 1.98

The prior art relates to lifting devices including a variety of lifting mechanisms for safely raising a framed wall of a building from a horizontal position into a vertical position. The prior art discloses a variety of hinge mechanisms that engage a bottom plate of a framed exterior wall for enhancing tilting the framed exterior wall into a vertical position. In no instance does the prior art disclose a bracket which engages a top plate of a framed exterior wall for lifting the framed exterior wall when the framed exterior wall is vertically oriented.

BRIEF SUMMARY OF THE INVENTION

An embodiment of the disclosure meets the needs presented above by generally comprising a bracket which includes a lateral portion forming a right angle with a lower portion and forming a right angle with an upper portion. The lower portion is spaced from the upper portion to define a wall space for insertably receiving a top plate of a framed exterior wall. The bracket has an attachment point integrated and a lifting line can engage the attachment point. In this way the framed exterior wall can be lifted with the lifting line when the bracket is positioned on the framed exterior wall. A plurality of nuts is each of the nuts is coupled to the upper portion of the bracket. A plurality of bolts is each threadable through a respective one of the nuts when the top plate is positioned in the wall space to inhibit the top plate from sliding out of the wall space when the bracket is lifted.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
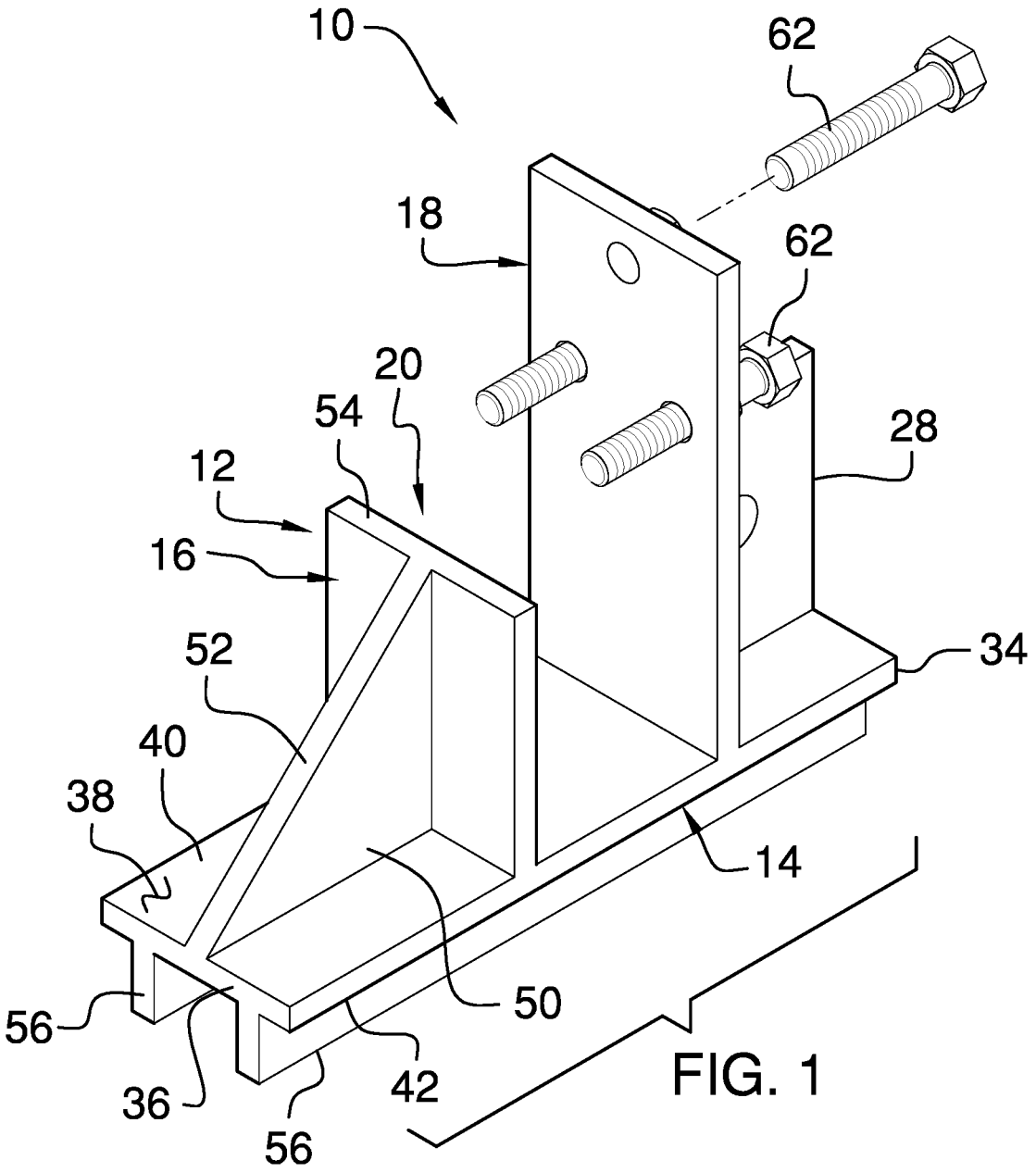
FIG. 1 is a perspective view of a wall lifting assembly according to an embodiment of the disclosure.
Figure 2:
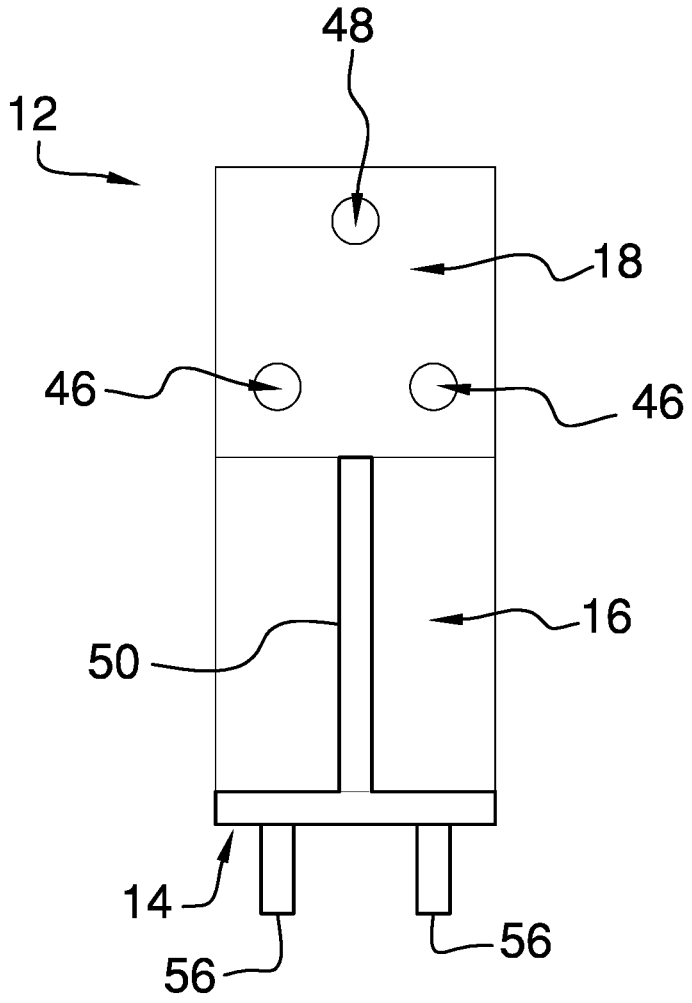
FIG. 2 is a bottom view of an embodiment of the disclosure.
Figure 3:
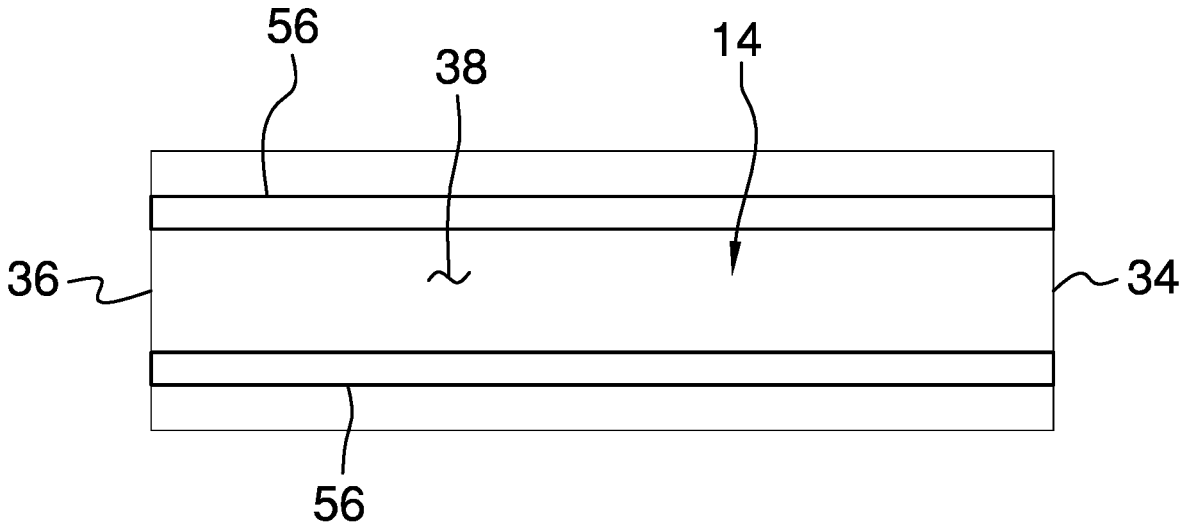
FIG. 3 is a back view of an embodiment of the disclosure.
Figure 4:
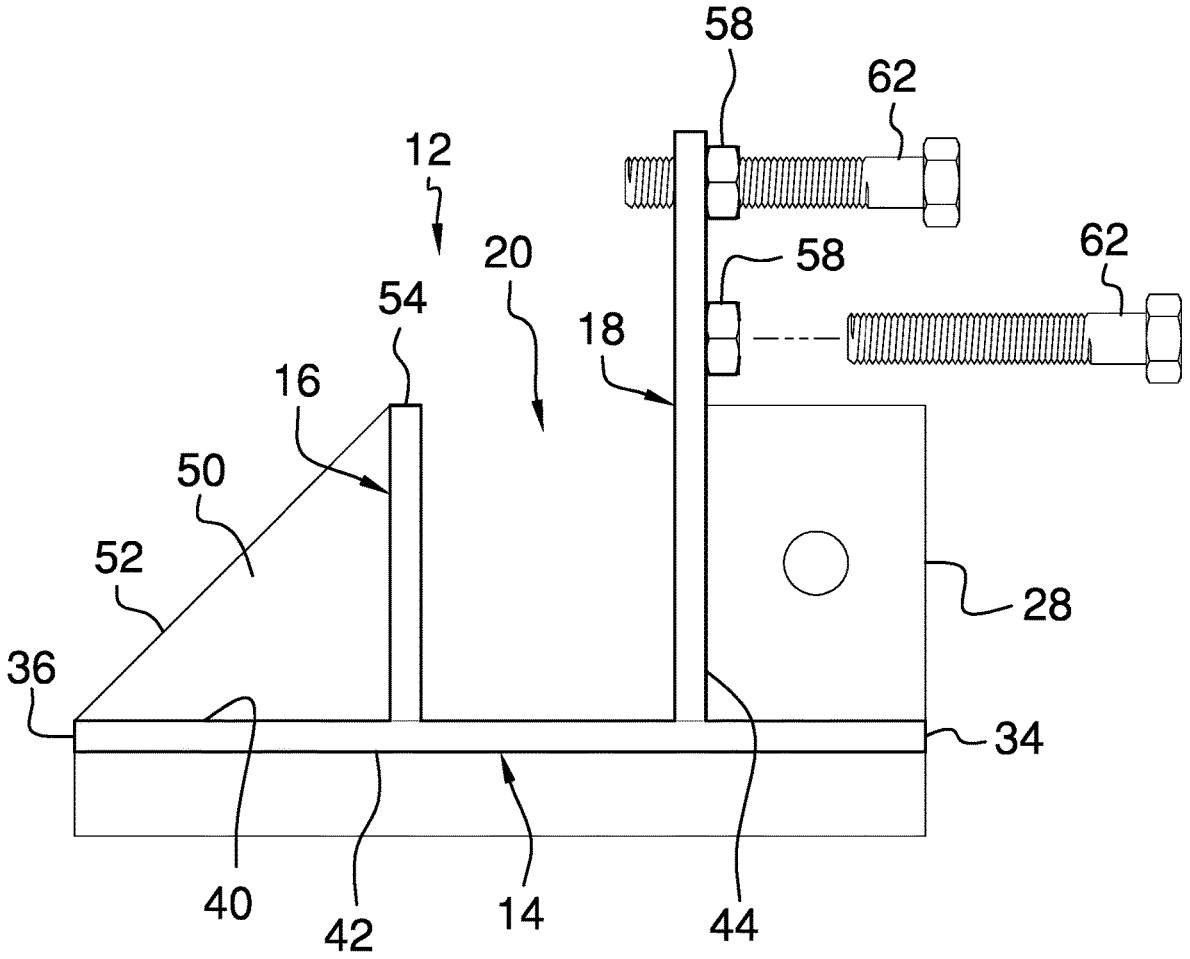
FIG. 4 is a left side view of an embodiment of the disclosure.
Figure 5:
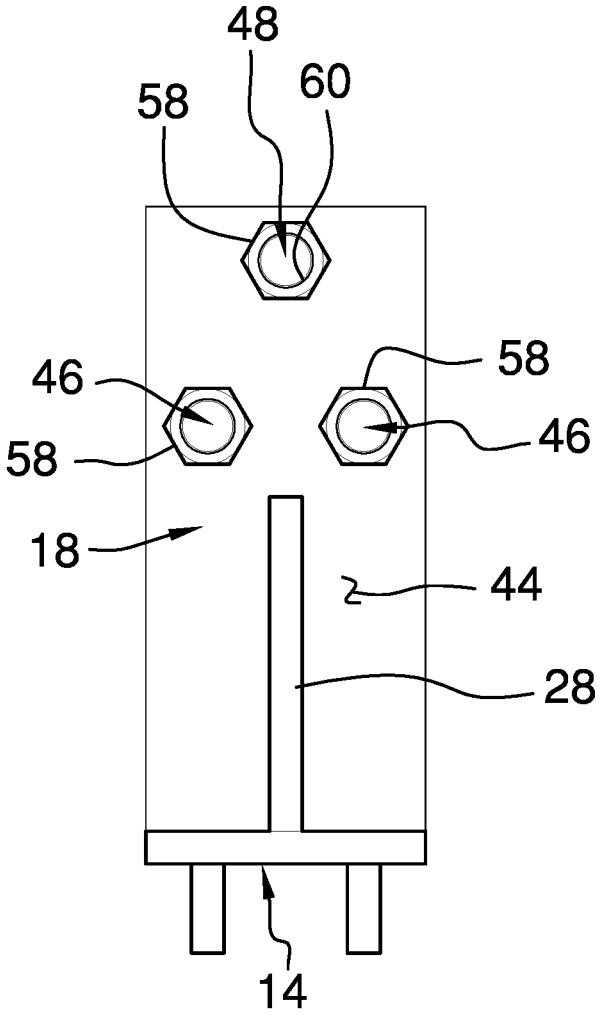
FIG. 5 is a top view of an embodiment of the disclosure.
Figure 6:
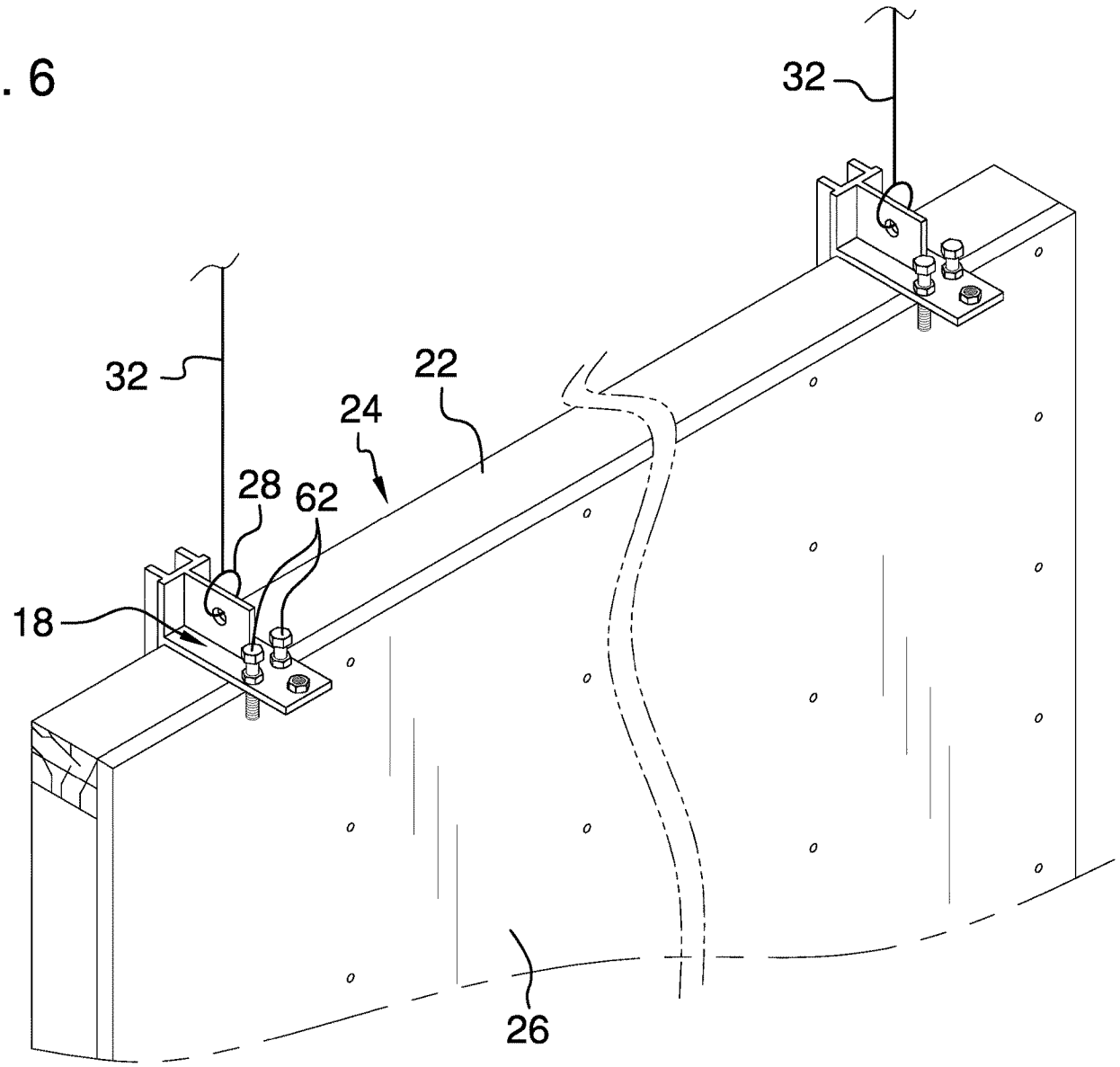
FIG. 6 is a perspective in-use view of an embodiment of the disclosure.
Figure 7:
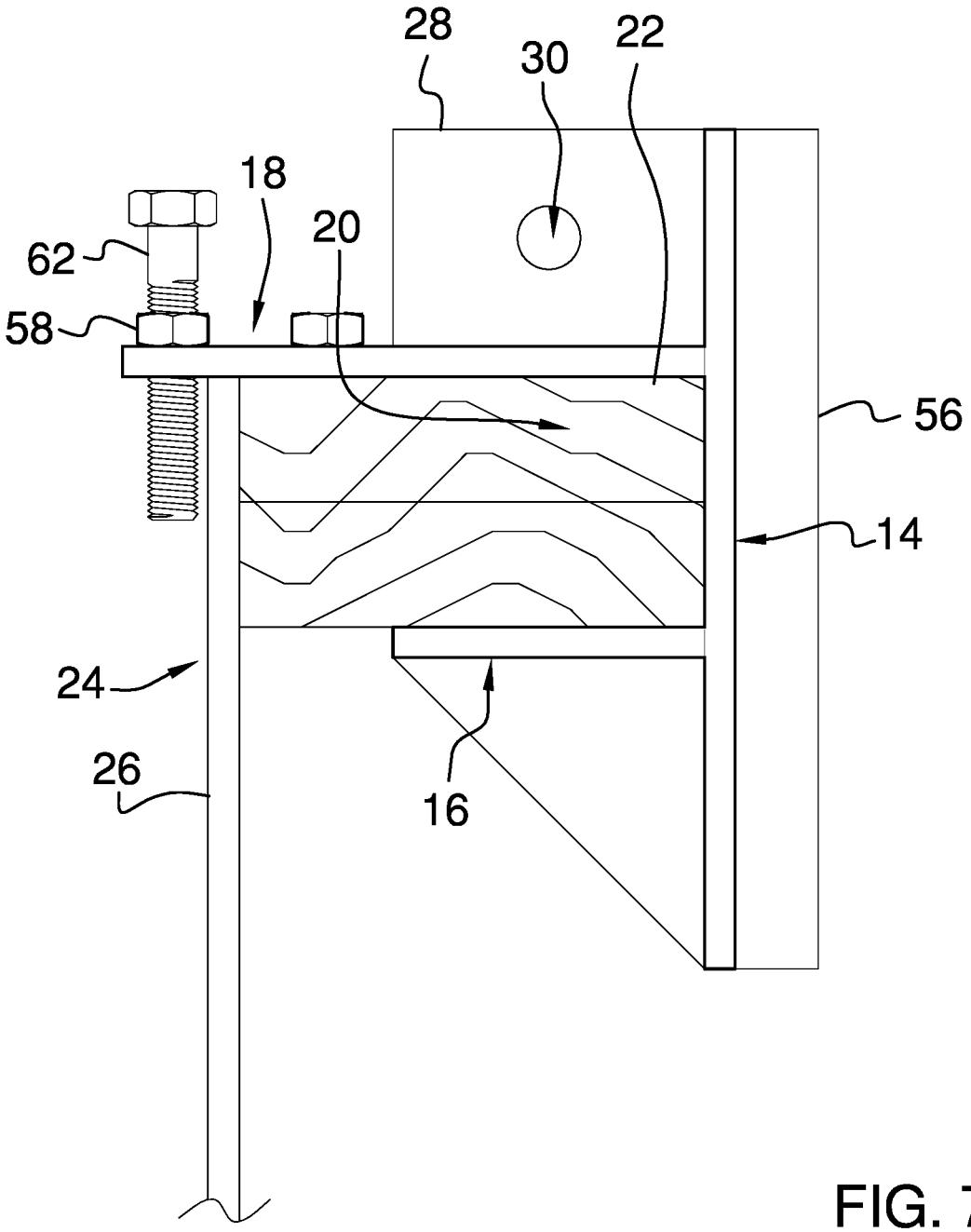
FIG. 7 is a perspective in-use view of an embodiment of the disclosure showing a top plate in a wall space.

With reference now to the drawings, and in particular to FIGS. 1 through 7 thereof, a new lifting device embodying the principles and concepts of an embodiment of the disclosure and generally designated by the reference numeral 10 will be described.

As best illustrated in FIGS. 1 through 7, the wall lifting assembly 10 generally comprises a bracket 12 which includes a lateral portion 14 forming a right angle with a lower portion 16 and forming a right angle with an upper portion 18. The lower portion 16 is spaced from the upper portion 18 to define a wall space 20 extending between the lower portion 16 and the upper portion 18. Moreover, the wall space 20 insertably received a top plate 22 of a framed exterior wall 24. The lower portion 16 is positioned beneath the top plate 22 and the upper portion 18 is positioned above the top plate 22. The framed exterior wall 24 may an exterior wall of a house that is under construction or other type of framed exterior wall, and the framed exterior wall 24 may include plywood sheathing 26.

The bracket 12 includes an upper gusset 28 that extends between the upper portion 18 and the lateral portion 14. The upper gusset 28 has a hole 30 extending through the upper gusset 28 and a lifting line 32 can extended through the hole 30. In this way the framed exterior wall 24 to be lifted with the lifting line 32 when the bracket 12 is positioned on the framed exterior wall 24. The lifting line 32 may be a cable of a crane or other type of lifting mechanism. The lower portion 16 may have a length of less than 3.5 inches such that the lower portion 16 can extend beneath the top plate 22 without striking the plywood sheathing 26. The upper portion 18 may have a length of greater than 6.0 inches such that the upper portion 18 extends outwardly beyond the plywood sheathing 26 when the top plate 22 is positioned in the wall space 20.

The lateral portion 14 has a top end 34, a bottom end 36 and an outer surface 38 extending between the top end 34 and the bottom end 36. The lateral portion 14 is elongated between the top end 34 and the bottom end 36, and the outer surface 38 has a front side 40 and a back side 42. Each of the lower portion 16 and the upper portion 18 is positioned on the front side 40 of the outer surface 38. The lower portion 16 is positioned between the top end 34 and the bottom end 36, and the upper portion 18 is positioned between the lower portion 16 and the top end 34. The upper gusset 28 extends between an upper surface 44 of the upper portion 18 and the top end 34 of the lateral portion 14.

The upper portion 18 has a set of first holes 46 that each extends through the upper portion 18 and each of the first holes 46 is spaced a first distance from the lateral portion 14. In this way each of the first holes 46 is positioned beyond the top plate 22 of the framed exterior wall 24 when the top plate 22 is positioned in the wall space 20 and when the top plate 22 has 2×4 framing dimensions. The first distance may be at least 4.0 inches. The upper portion 18 has a second hole 48 extending through the upper portion 18 and the second hole 48 is spaced a second distance from the lateral portion 14. In this way the second hole 48 is positioned beyond the top plate 22 of the framed exterior wall 24 when the top plate 22 is positioned in the wall space 20 and the top plate 22 has 2×6 framing dimensions. Additionally, the second distance may be at least 6.0 inches.

The bracket 12 includes a lower gusset 50 that extends between the lower portion 16 and the lateral portion 14, and the lower gusset 50 extends between the lower portion 16 and the bottom end 36 of the lateral portion 14. The lower gusset 50 has an exposed edge 52 that angles between a distal edge 54 of the lower portion 16 and the bottom end 36 of the lateral portion 14. A pair of ribs 56 is each coupled to the lateral portion 14 of the bracket 12 for enhancing rigidity of the lateral portion 14. Each of the ribs 56 is positioned on the back side 42 of the outer surface 38 of the lateral portion 14 and each of the ribs 56 extends between the bottom end 36 and the top end 34.

A plurality of nuts 58 is provided and each of the nuts 58 is coupled to the upper portion 18 of the bracket 12. Each of the nuts 58 is aligned with a respective one of the first holes 46 or the second hole 48, and each of the nuts 58 has an inner surface 60 that is threaded. A plurality of bolts 62 is each threadable through a respective one of the nuts 58 when the top plate 22 is positioned in the wall space 20. In this way the bolts 62 can inhibit the top plate 22 from sliding out of the wall space 20 when the bracket 12 is lifted. Each of the bolts 62 may be threaded bolts of any conventional design that are compatible with the nuts 58.

In use, one or more of the bracket(s) 12 is slid onto the top plate 22 of the framed exterior wall 24 from inside of the building that is being built. In this way top plate 22 is positioned between the upper portion 18 and the lower portion 16 of the bracket 12. Each of the bolts 62 is threaded into respective nuts 58 that are aligned with the first holes 46 to inhibit the top plate 22 from sliding out of the wall space 20 when the top plate 22 is a 2×4. One of the bolts 62 is threaded into the nut that is aligned with the second hole 48 to inhibit the top plate 22 from sliding out of the wall space 20 when the top plate 22 is a 2×6. The lifting line 32 is extended through the hole 30 in the upper gusset 28 to facilitate the lifting line 32 to lift the bracket 12 and the framed exterior wall 24. In this way the framed exterior wall 24 can be lifted when the framed exterior wall 24 is in a vertical orientation to facilitate installing appliances, for example, in a house that is under construction.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wall lifting assembly being attachable to an exterior wall of a building thereby facilitating the exterior wall to be lifted, said assembly comprising:

a bracket comprising a lateral portion forming a right angle with a lower portion and forming a right angle with an upper portion, said lower portion being spaced from said upper portion to define a wall space extending between said lower portion and said upper portion thereby facilitating said wall space to insertably receive a top plate of a framed exterior wall having said lower portion being positioned beneath the top plate and having said upper portion being positioned above the top plate, said bracket having an attachment point being integrated therein wherein said attachment point is configured to have a lifting line engaged to said attachment point thereby facilitating the framed exterior wall to be lifted with the lifting line when said bracket is positioned on the framed exterior wall, said upper portion having a plurality of holes extending through said upper portion;

a plurality of nuts, each of said nuts being coupled to said upper portion of said bracket, each of said nuts being aligned with a respective one of said holes;

a plurality of bolts, each of said bolts being threadable through a respective one of said nuts when the top plate is positioned in said wall space wherein said bolts are configured to inhibit the top plate from sliding out of said wall space when said bracket is lifted; and wherein said bracket includes an upper gusset extending between said upper portion and said lateral portion, said upper gusset having a hole extending through said upper gusset, said hole defining said attachment point.

2. The assembly according to claim 1, wherein said lateral portion has a top end, a bottom end and an outer surface extending between said top end and said bottom end, said lateral portion being elongated between said top end and said bottom end, said outer surface having a front side and a back side, each of said lower portion and said upper portion being positioned on said front side of said outer surface, said lower portion being positioned between said top end and said bottom end, said upper portion being positioned between said lower portion and said top end, said upper gusset extending between said upper portion and said top end.

3. The assembly according to claim 2, wherein said plurality of holes includes a set of first holes each extending through said upper portion, each of said first holes being spaced a first distance from said lateral portion wherein each of said first holes is configured to be positioned beyond the top plate of the framed exterior wall when the top plate is positioned in said wall space and when the top plate has 2×4 framing dimensions.

4. The assembly according to claim 3, wherein said plurality of holes includes a second hole extending through said upper portion, said second hole being spaced a second distance from said lateral portion wherein said second hole is configured to be positioned beyond the top plate of the framed exterior wall when the top plate is positioned in said wall space and the top plate has 2×6 framing dimensions.

5. The assembly according to claim 1, wherein said bracket includes a lower gusset extending between said lower portion and said lateral portion, said lower gusset extending between said lower portion and said bottom end of said lateral portion, said lower gusset having an exposed edge angling between a distal edge of said lower portion and said bottom end of said lateral portion.

6. The assembly according to claim 1, further comprising a pair of ribs, each of said ribs being coupled to said lateral portion of said bracket for enhancing rigidity of said lateral portion, each of said ribs being positioned on said back side of said outer surface of said lateral portion, each of said ribs extending between said bottom end and said top end.

7. A wall lifting assembly being attachable to an exterior wall of a building thereby facilitating the exterior wall to be lifted, said assembly comprising:

a bracket comprising a lateral portion forming a right angle with a lower portion and forming a right angle with an upper portion, said lower portion being spaced from said upper portion to define a wall space extending between said lower portion and said upper portion thereby facilitating said wall space to insertably receive a top plate of a framed exterior wall having said lower portion being positioned beneath the top plate and having said upper portion being positioned above the top plate, said bracket including an upper gusset extending between said upper portion and said lateral portion, said upper gusset having a hole extending through said upper gusset wherein said hole is configured to have a lifting line extended through said hole thereby facilitating the framed exterior wall to be lifted with the lifting line when said bracket is positioned on the framed exterior wall, said lateral portion having a top end, a bottom end and an outer surface extending between said top end and said bottom end, said lateral portion being elongated between said top end and said bottom end, said outer surface having a front side and a back side, each of said lower portion and said upper portion being positioned on said front side of said outer surface, said lower portion being positioned between said top end and said bottom end, said upper portion being positioned between said lower portion and said top end, said upper gusset extending between said upper portion and said top end, said upper portion having a set of first holes each extending through said upper portion, each of said first holes being spaced a first distance from said lateral portion wherein each of said first holes is configured to be positioned beyond the top plate of the framed exterior wall when the top plate is positioned in said wall space and when the top plate has 2×4 framing dimensions, said upper portion having a second hole extending through said upper portion, said second hole being spaced a second distance from said lateral portion wherein said second hole is configured to be positioned beyond the top plate of the framed exterior wall when the top plate is positioned in said wall space and the top plate has 2×6 framing dimensions, said bracket including a lower gusset extending between said lower portion and said lateral portion, said lower gusset extending between said lower portion and said bottom end of said lateral portion, said lower gusset having an exposed edge angling between a distal edge of said lower portion and said bottom end of said lateral portion;

a pair of ribs, each of said ribs being coupled to said lateral portion of said bracket for enhancing rigidity of said lateral portion, each of said ribs being positioned on said back side of said outer surface of said lateral portion, each of said ribs extending between said bottom end and said top end;

a plurality of nuts, each of said nuts being coupled to said upper portion of said bracket, each of said nuts being aligned with a respective one of said first holes or said second hole, each of said nuts having an inner surface being threaded; and a plurality of bolts, each of said bolts being threadable through a respective one of said nuts when the top plate is positioned in said wall space wherein said bolts are configured to inhibit the top plate from sliding out of said wall space when said bracket is lifted.

* * * * *